US006508525B2

(12) United States Patent
Picogna

(10) Patent No.: US 6,508,525 B2
(45) Date of Patent: Jan. 21, 2003

(54) SCRAPBOOK NOOK

(76) Inventor: Nancy H. Picogna, 1860 Goodwin Dr. NW., Cullman, AL (US) 35058

( * ) Notice: Subject to any disclaimer, the term of this patent is extended or adjusted under 35 U.S.C. 154(b) by 44 days.

(21) Appl. No.: 09/764,454

(22) Filed: Jan. 19, 2001

(65) Prior Publication Data

US 2002/0043907 A1 Apr. 18, 2002

Related U.S. Application Data

(60) Provisional application No. 60/177,663, filed on Jan. 27, 2000.

(51) Int. Cl.[7] ..... A47B 17/00

(52) U.S. Cl. ..... 312/196; 312/297; 312/348.3

(58) Field of Search ..... 312/107, 108, 312/109, 194, 195, 196, 282, 297, 326, 329, 348.3, 348.5, 223.5

(56) References Cited

U.S. PATENT DOCUMENTS

| | | | | |
|---|---|---|---|---|
| 315,725 | A | * | 4/1885 | Caughy |
| 842,780 | A | * | 1/1907 | Gardner |
| 1,072,280 | A | * | 9/1913 | Walker |
| 1,099,521 | A | | 6/1914 | Sprung |
| 1,135,162 | A | * | 4/1915 | Davis |
| 1,292,055 | A | * | 1/1919 | Porter |
| 2,698,213 | A | * | 12/1954 | Hughes |
| 4,163,592 | A | * | 8/1979 | Nelson |
| 4,304,447 | A | * | 12/1981 | Ellwood et al. |
| 5,121,974 | A | | 6/1992 | Monson |
| 5,312,177 | A | * | 5/1994 | Coulter |
| 5,544,764 | A | * | 8/1996 | Cima |
| D376,491 | S | | 12/1996 | Kelley |
| D376,496 | S | | 12/1996 | Kelley et al. |
| 5,590,940 | A | | 1/1997 | Richard |
| 5,678,905 | A | | 10/1997 | Kelley |
| 5,695,264 | A | | 12/1997 | Koch |
| 5,738,422 | A | | 4/1998 | Welborn, Jr. et al. |
| 5,842,758 | A | | 12/1998 | Kelley |
| 5,927,833 | A | | 7/1999 | Kelley |

FOREIGN PATENT DOCUMENTS

| | | |
|---|---|---|
| FR | 2650494 | 2/1991 |

* cited by examiner

*Primary Examiner*—Janet M. Wilkens
(74) *Attorney, Agent, or Firm*—Richard C. Litman

(57) ABSTRACT

A scrapbook nook or desk having two side walls, a first back wall, a second back wall, a top wall, a top storage unit, a desktop work area, a roll-top member, slide-out work surfaces, a plurality of drawers, a cork board, and a light source. Assembling scrapbooks usually requires large items such as a XYRON machine and Photo storage boxes. The top storage unit is constructed specifically to store these particular items. The desktop includes an opening constructed to receive trash which is then dropped into a compartment with a drawer located beneath the desktop. The top surface of the desktop supports a writing instrument storage unit which comprises a honeycomb-shaped structure that vertically houses writing instruments for easy accessibility.

18 Claims, 4 Drawing Sheets

SCRAPBOOK NOOK

CROSS-REFERENCE TO RELATED APPLICATION

This application claims the benefit of U.S. Provisional Patent application Ser. No. 60/177,663, filed Jan. 27, 2000.

BACKGROUND OF THE INVENTION

1. Field of the Invention

The present invention relates to a scrapbook nook (a desk-like construction), and more specifically, a scrapbook nook constructed to increase horizontal work space for assembling scrapbooks, and also provide drawers specifically constructed to store various sized and shaped related items.

2. Description of Related Art

Compiling scrapbooks of memories or artwork has been a tradition in family homes for centuries. There are two common complaints about assembling scrapbooks. One complaint is that there is not enough room to make a scrapbook. Another complaint involves getting everything out and putting it all away each time a person wants to work on their scrapbook, which can be very time consuming.

The following design patents illustrate ornamental designs of various desks. U.S. Des. Pat. No. 376,491, issued to James O. Kelley on Dec. 17, 1996, illustrates a computer secretary. The ornamental design includes two separate compartments enclosed by four doors. The compartments include shelves, drawers, and a work surface, but does not include a roll top cover. U.S. Des. Pat. No. 376,496, issued to Kelly, et al. on Dec. 17, 1996, illustrates a computer workplace having one major compartment enclosed by two doors.

The following patents disclose various types of desks and work stations. U.S. Pat. No. 1,099,521, issued to Abbe Sprung on Jun. 9, 1914, describes an office desk including a pigeon hole rack in which letters or papers may be quickly filed. It has an ordinary flat top desk which may raise the pigeon hole rack by a trip element actuated by the operator.

U.S. Pat. No. 5,121,974, issued to Alan R. Monson on Jun. 16, 1992, describes a computer desk apparatus with parallel walls formed with a front wall defining a central cavity. The central cavity is positioned between a right series of storage drawers and a left storage door positioned hingedly in front of a printer cavity which further includes a medially positioned slide-out drawer. Extending upwardly from a lower desk plate are right and left storage shelves. The upper cavity includes a roll-top member directed over the cavity to provide protection for the organization when not in use.

U.S. Pat. No. 5,590,940, issued to Michael B. Richard on Jan. 7, 1997, describes a sliding rack cabinet for dressers. The cabinet includes a rectilinearly shaped cabinet member having a peripheral edge wall. The back wall is connected to and spanning the peripheral edge wall. A tie is rack mounted to the peripheral edge wall adjacent to the top edge wall.

U.S. Pat. No. 5,695,264, issued to David T. Koch on Dec. 9, 1997, describes a portable office unit with an enclosure that includes two hingedly connected shells. U.S. Pat. No. 5,738,422, issued to Welborn, Jr. et al. on Apr. 14, 1998, describes a computer work station which includes a first desk unit with a front tapered edge. The first desk unit has an electrical control panel with surge protected outlets. The work station has a second desk unit, one end of the second desktop being inserted into and supported by a support rail in a bookcase and the other end being placed upon and secured to a file cabinet.

U.S. Pat. No. 5,842,758, issued to James O. Kelley on Dec. 1, 1998, describes a sky cabinet work station having a pair of opposing side panels which have vertically oriented elongated members. The top includes a transparent or translucent panel which is adapted to transmit light through the panel to illuminate the work station.

U.S. Pat. No. 5,678,905, issued to James O. Kelley on Oct. 21, 1997, and U.S. Pat. No. 5,927,833, issued to James O. Kelley on Jul. 27, 1999, both describes a concealed desk which comprises a desktop or work surface with supporting side panels, a kneehole opening, and storage compartments. The front of the desk is enclosable by folding doors mounted on front side edges of the desk's side panels.

When the doors are opened, the doors preferably fold against the side panels of the desk and do not obstruct either the appearance or the use of the desk. The desktop surface of the desk is concealed by an upper storage unit that is mounted on the desktop or that comprises an extension of the desk, above the desktop or work surface. Full lengths doors enclose both the upper and lower portions of the desk to give the furniture the appearance of an armoire. French Pat. No. 2,650,494, published Feb. 8, 1991, describes a work place for a computer having lower shelving and storage units.

Normal sized shelves and drawers cannot accommodate the various large sizes of scrapbooks, paper, and equipment used in preparing scrapbooks. An ideal work surface would include a large sized work surface with drawers specifically constructed to hold various sized scrapbooks and items. In addition, a holder for pens, markers, and pencils constructed on the work surface for easy accessibility to aid the assembler of a scrapbook would be beneficial.

None of the above inventions and patents, taken either singly or in combination, is seen to describe the instant invention as claimed.

SUMMARY OF THE INVENTION

The present invention is a scrapbook nook or desk which includes two side walls, a first back wall, a second back wall, a top wall, a top storage unit, a desktop work area, a roll-top member, slide-out work surfaces, a plurality of drawers, a plurality of doors, a cork board, and a light source. A plurality of doors enclose openings within the top storage unit, and the doors are hinged to permit them to open outwardly towards the middle or sides of the nook.

Assembling scrapbooks usually requires large items such as a XYRON machine (Xyron is a trademark of Xyron, Incorporated of Scottsdale, Ariz. for an office machine for applying protective plastic film laminate and/or adhesive mount) and Photo storage boxes. The top storage unit is constructed specifically to store these particular items. The second back wall has a first section which is vertically flat and a second section which is a horizontal wall attached to the vertical wall at approximately a 90 degree angle. The first and second sections house a roll-top member.

The desktop includes an opening constructed to receive trash which is then dropped into a compartment within a drawer located beneath the desktop. The top surface of the desktop supports a writing instrument storage unit which is honeycomb-shaped and vertically houses writing instruments for easy accessibility.

The top surface of the desktop also supports a first and second slot each for receiving either a light box or a personal trimmer. A roll-top member encloses the work space cavity between the desktop and beneath the top storage unit. The lower portion of the scrapbook nook includes a plurality of horizontal slide-out work surfaces, a plurality of drawers, a plurality of doors, and a kneehole. Each drawer in the lower portion of the scrapbook nook is constructed for a specific function relating to the assembling of scrapbooks.

Accordingly, it is a principal object of the invention to provide a scrapbook nook that increases the amount of work space available for assembling scrapbooks.

It is another object of the invention to provide a scrapbook nook that includes a plurality of drawers constructed to store various shaped and sized scrapbook items.

It is a further object of the invention to provide a scrapbook nook with a top storage unit specifically constructed to store a XYRON machine and Photo storage boxes.

Still another object of the invention is to provide a pen, marker, and pencil holder attached to the desktop for easy accessibility to aid the assembler of a scrapbook.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
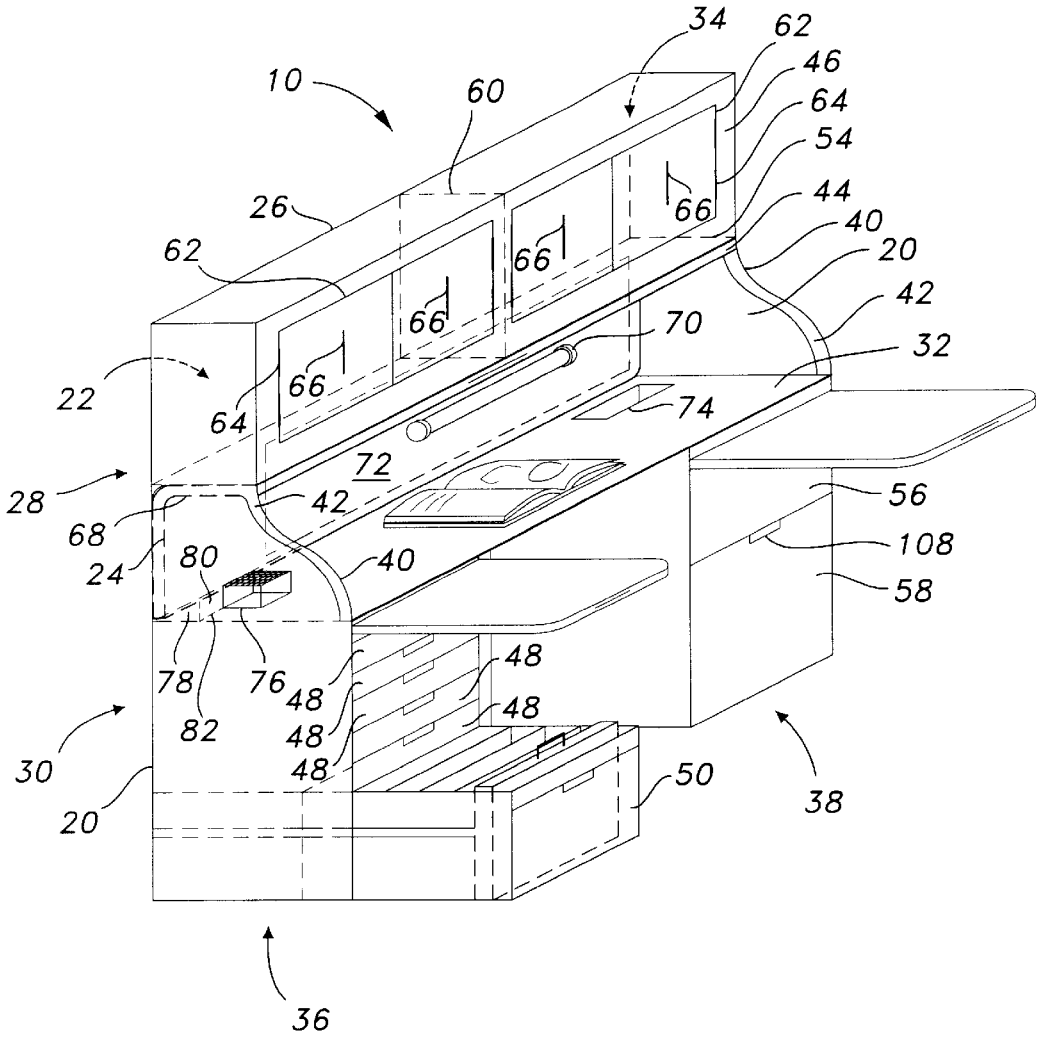
FIG. 1 is an environmental, perspective view of a first example of the scrapbook nook according to the present invention.

The present invention is a scrapbook nook designated as 10 in the drawings. The scrapbook nook 10 is a unitary structure constructed to meet the storage, accessibility, aesthetics, and work space needs for assembling scrapbooks.

FIG. 1 illustrates the scrapbook nook 10 which comprises two side walls 20, a first back wall 22, a second back wall 24 and 68, and a top wall 26. The scrapbook nook 10 further comprises an upper 28 and lower 30 portion which are separated by a horizontally positioned desktop 32 for working space to assemble scrapbooks. The first back wall 22 extends along both the upper 28 and lower portion 30 of the scrapbook nook 10. The upper portion 28 of the scrapbook nook 10 comprises the top storage unit 34 and the cavity above the desktop 32. The scrapbook nook 10 has a left 36 and right 38 side.

Each side wall 20 is constructed with upper and lower rectangular portions joined by a middle section having a front edge forming an "S" shaped curvature 40. The upper rectangular section is of each side wall 20 is narrower in width than the lower rectangular portion, the upper section preferably measuring about thirteen inches from front to back, and the lower section preferably measuring about twenty-four inches from front to back. Each side wall 20 may be made in one piece, or it may be made in three separate sections which may optionally be covered with a veneer panel for appearance. There is a right 38 "S" shaped 40 side wall 20 spaced from, parallel, and coextensive to a left 36 "S" shaped 40 side wall 20. The right 38 side wall 20 and a left 36 side wall 20 have the "S" shaped 40 side exposed to the front of the scrapbook nook 10. The "S" shaped curvature 40 makes the upper portion 28 of each side wall 20 approximately half the size in width to the lower portion 30 of the side wall 20. Each side wall 20 comprises a groove 42 along the inside surface of the "S" shape 40 and along the area that borders the space which houses the roll-top member 44 which is later mentioned.

Construction of the scrapbook nook 10 can be achieved by any conventional means known in the art of assembling furniture, such as dove-tail or other joinery techniques using screws, dowels or other fasteners. The first back wall 22, second back wall 24 and 68, front wall 46, top wall 26, side panels 20, desktop 32, and drawers 48, 50, 52, 56, and 58, can be comprised of materials that are standard in the art of desks and cabinets, such as wood, composites, and metal.

The upper portion 28 of the scrapbook nook 10 comprising the top storage unit 34 extends across the upper first back wall 22 above the desktop 32. The top storage unit 34 includes a top wall 26, bottom wall 54, and a front wall 46. The front wall 46 includes two rectangular-shaped openings (not shown) spaced evenly apart from one another. The top wall 26 of the nook 10 is also the top wall 26 of the top storage unit 34. The front wall 46 comprises an outer surface and inner surface. The top storage unit 34 preferably includes one inner intermediate vertical support wall 60 dividing the top storage unit 34 into two storage components.

A plurality of doors 62 enclose the openings within the top storage unit 34 and are attached by hinges 64 to permit the doors 62 to open outwardly towards the middle or sides of the nook 10. Preferably, each opening is covered by two doors 62 which are pivotally hinged 64 to the front wall 46 outer surface along the vertical periphery of each opening. Each top storage door 62 may include a handle 66.

Each handle 66 is secured onto each top storage door 62 in a conventional manner known in the art of fastening handles 66 onto cabinet-type doors. The preferred arrangement in which the top storage doors 62 would be displayed is to have the four doors 62 positioned in two pairs. The two openings and four door 62 construction is the entry way into the top storage unit 34 and is constructed in this way to allow for large items to be stored in this area. Assembling scrapbooks usually requires large items such as a XYRON machine and Photo storage boxes. The top storage unit 34 is sized and dimensioned specifically to store these particular items. In a preferred embodiment, the storage unit 34 is about fourteen inches high and thirteen inches deep. When divided by the intermediate vertical support wall 60, each compartment is about thirty-three inches wide.

The second back wall 24 and 68 is dimensioned and configured to fit between the upper portion of the first back wall 22 above the desktop 32 and below the top storage unit 34. The second back wall 24 and 68 comprises two sections. The first section is a vertical flat wall 24 and the second section is a horizontal wall 68 attached to the vertical wall 24 at approximately a 90 degree angle. The second back wall 24 and 68, the bottom wall 54 of the top storage unit 34, and the first back wall 22, support and aid in housing a roll-top member 44.

A light source 70 is secured to the second section of the second back wall 68 of the top storage unit 34. The vertical wall of the second back wall 24 includes a cork board 72 or other material that will serve as a tack board. The cork board 72 and the second back wall 24 extend across the entire back wall 22 of the scrapbook nook 10. The height of the second back wall 24 and 68 does not touch the bottom wall 54 of the top storage unit 34. The space between the second back wall 68 and the bottom wall 54 of the top storage unit 34 defines a cavity which allows enough space for a roll-top member 44 to pass through.

A desktop 32 extends across the entire length of the scrapbook nook 10. The desktop 32 has a top surface, a bottom surface, a right side 38, and a left side 36. The desktop 32 can be constructed of materials known in the art of desks and cabinets. The preferred materials used to manufactured the desktop 32 would be wood, plastic, or metal with a hard vinyl lining on the top surface of the desktop 32. The desktop 32 comprises an opening 74 located on the right side 38 of the desktop 32 and nearest to the back wall 24. The opening 74 in the desktop 32 is dimensioned and configured to receive trash which is dropped through the desktop 32 opening 74 and into a compartment within a drawer 56 located beneath the desktop 32.

The top surface of the desktop 32 supports a writing instrument storage unit 76 which comprises a honeycomb-shaped structure that vertically houses writing instruments for easy accessibility. The writing instrument storage unit 76 can be secured anywhere on the top surface of the desktop 32. Preferably, the writing instrument storage unit 76 is secured onto the top surface of the left side 36 of the desktop 32 near the first section of the second back wall 24. The writing instrument storage unit 76 can be secured to the top surface of the desktop 32 by a number of fastening means such as glue, screws, or VELCRO (VELCRO is a trademark of Velcro, Inc. of Manchester, N.H., now owned by Velcro Industries, B.V., for hook and loop fasteners).

The top surface of the desktop 32 also supports a first 78 and second 80 slot each dimensioned and configured to either receive a light box or a personal trimmer. The first 78 and second 80 slots are positioned between the writing instrument storage unit 76 and the first section of the second back wall 24. The first 78 and second 80 slots are partitioned by a small vertical divider 82 which is relatively the same height as the writing instrument storage unit 76.

Figure 2:
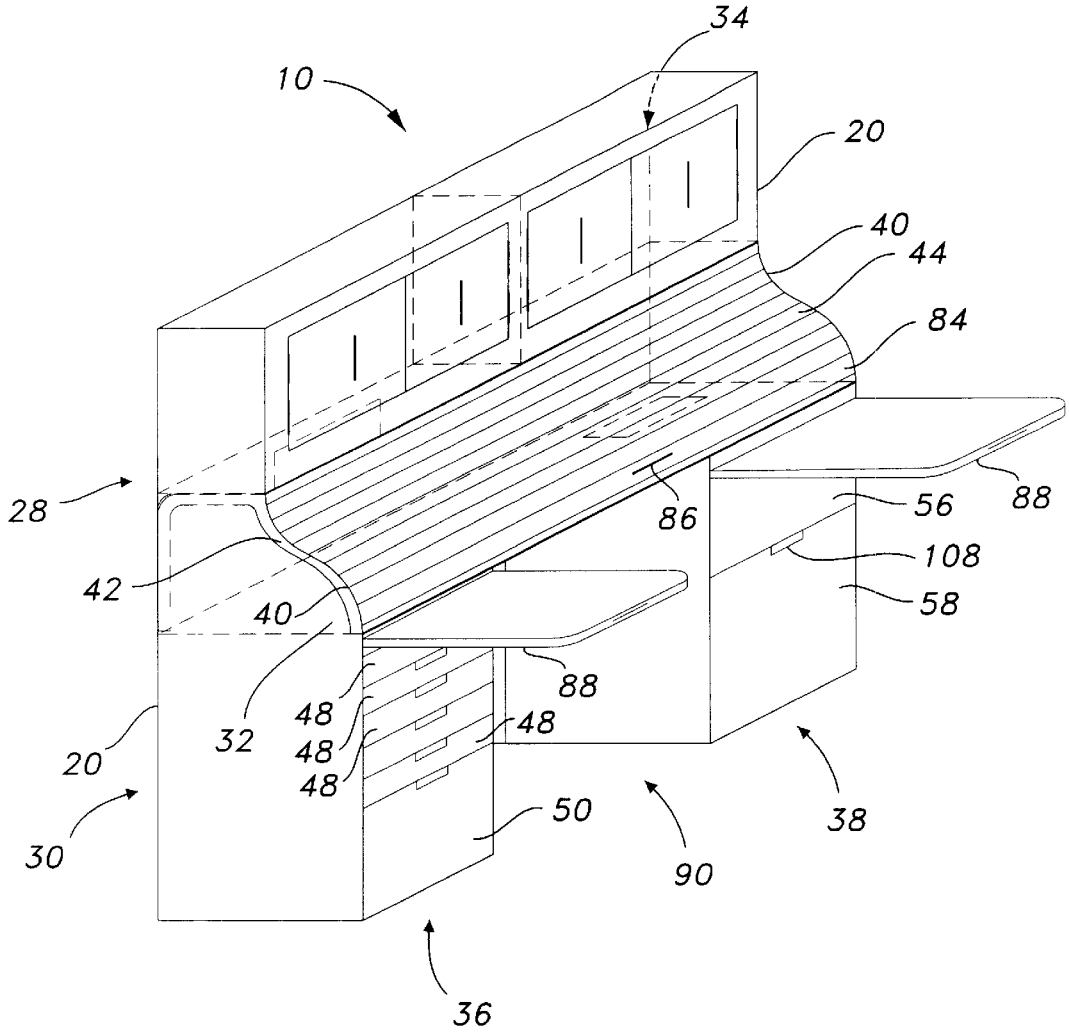
FIG. 2 is an environmental, perspective view of a scrapbook nook of the present invention showing the roll-top desk with the roll-top cover in the closed position.

FIG. 2 illustrates a roll-top member 44 which encloses the work space cavity between the desktop 32 and the top storage unit 34. The roll-top member 44 is formed of wooden slats to enclose the work space cavity. The roll-top member 44 may be a tambour formed from a plurality of parallel wooden slats glued to a canvas backing. The roll-top member 44 is slidably received in grooves 42 defined in the S-shaped middle sections of the side walls 20 of the scrapbook nook 10. These grooves 42 within the side walls 20 enable the roll-top member 44 to be opened and closed in the normal fashion in which a roll-top is used. The leading slat 84 of the roll-top member 44 includes a handle 86 for easily opening and closing the work space cavity.

The lower portion 30 of the scrapbook nook 10 comprises a plurality of horizontal slide-out work surfaces 88, a plurality of drawers 48, 50, 52, 56, and 58, a plurality of doors 110 (shown in FIG. 4), and a kneehole 90. A plurality of horizontal slide-out work surfaces 88 are mounted above each set of drawers 48, 50, 52, 56, and 58 and beneath the desktop 32. The exposed corners of each horizontal slide-out work surface 88 are rounded for safety. Each horizontal slide-out work surface 88 can be flush with the front surface of the drawers 48 when left in the closed position. Due to scrapbooks taking up an incredible amount of work space, providing two additional slide-out work surfaces 88 will alleviate this problem.

The scrapbook nook 10 comprises a plurality of drawers 48, 50, 52, 56, and 58. The interior of the drawers do not house conventional storage compartments that might be present in a conventional desk. In fact, each drawer 48, 50, 52, 56, and 58 is constructed for a specific function relating to the assembling of scrapbooks. Preferably, the scrapbook nook 10 comprises two sets of drawers 48, 50, 52, 56, and 58 with each set positioned directly beneath each slide-out work surface 88. The scrapbook nook 10 comprises a first 48, 50 or 52 and second 56 and 58 set, or pedestal, of drawers. The first set of drawers 48, 50 or 52 are positioned on the left side 36 of the scrapbook nook 10 and the second set of drawers 56 and 58 are positioned on the right side 38.

The first set of drawers comprises a plurality of equally sized shallow box-shaped drawers 48 and one large storage drawer 50 or 52 with several vertical tiers. Each of the equally sized drawers 48 has a specific purpose. The preferred number of equally sized drawers 48 is four. The drawers 48 will be described from top to bottom as follows. The first drawer 48 is constructed for storing variously sized and shaped scissors. The second drawer 48 is constructed for storing "corner rounders" and "punches". The third drawer 48 is constructed for storing various types of stamps. The fourth or final equally sized drawer 48 is constructed for storing stamp pads, various sized rulers, and for oval and circle cutters.

Figure 3:
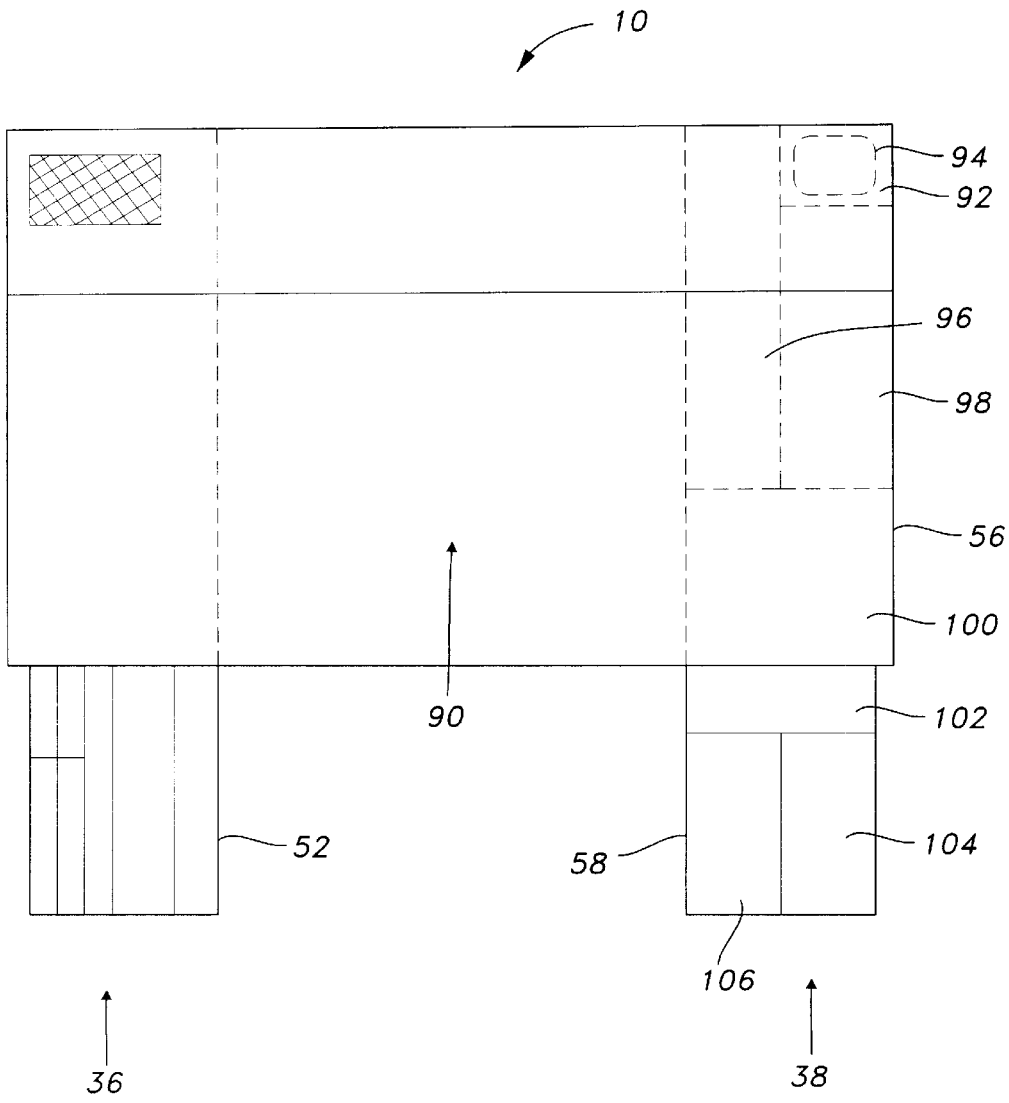
FIG. 3 a top view of a second embodiment of the desktop and drawers of scrapbook nook of the present invention.

FIG. 3 illustrates an embodiment of the other drawer 50 or 52 in the first set of drawers, the two different large storage drawers 50 and 52 being constructed for two different purposes. The drawer 52 shown in FIG. 3 includes vertical tiers with partition walls extending from front to back to hold a plurality of 8×10 albums, a template, a sticker storage, and a 12×15 album. FIG. 1 illustrates the other embodiment of the large storage drawer 50, which includes vertical tiers with partition walls extending from side to side to divide the drawer 50 into six vertical storage spaces.

FIG. 3 illustrates the second set of drawers 56 and 58 comprises two box-shaped drawers each, including vertical tiers. The second set of drawers 56 and 58 comprise two drawers including an upper 56 and lower 58 drawers. The upper drawer 56 is unique in that there is a trash compartment 92 constructed between one of the vertical tiers and the walls of the drawer 56. The trash compartment 92 may include a removable trash container 94 for easy removal of trash.

The upper drawer 56 is a box-shaped drawer with a plurality of vertical tiers each constructed and arranged to store 12×12 paper with page protectors 96, 8×10 paper with page protectors 98, a trash compartment 92, and a storage space for current projects 100. The lower drawer 58 is a box-shaped drawer with a plurality of vertical tiers specifically arranged to store "Idea books" 102, 12×12 albums 104, and for "letter" storage 106. All the vertical tiers or partition walls within each drawer 48, 50, 52, 56, and 58 are relatively the same height and either the same width or length (according to whether the partition walls extend from side-to-side or front-to-back, respectively) as the box-shaped drawers. Each drawer 48, 50, 52, 56, and 58 includes a flush-type drawer pull handle or a half-moon shape recess as its handle (shown in FIGS. 1 and 2). Between the first 48 and 52 and second set of drawers 56 and 58 is a cavity 90 or kneehole dimensioned and configured to receive a desk chair.

Figure 4:
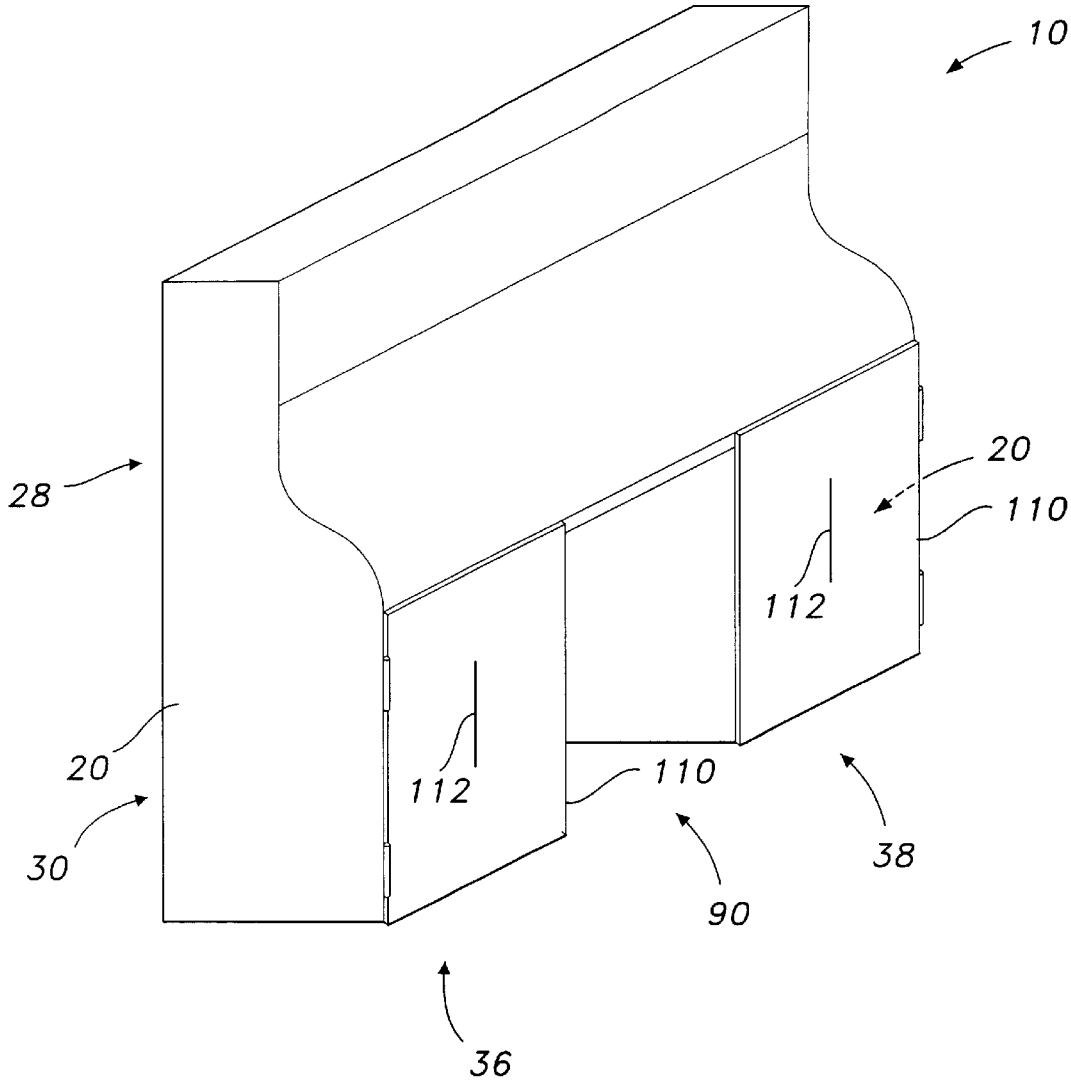
FIG. 4 is an environmental, perspective view of a third example of the scrapbook nook showing doors mounted on the lower portion of the nook of the present invention.

FIG. 4 illustrates the lower portion 30 of the scrapbook nook 10 where the left and right drawers are positioned. The first set of drawers, including 48 and 50 or 52, is enclosed by a door 110, and the second set of drawers, including 56 and 58 is enclosed by a second door 110. The doors 110 are mounted on hinges that pivot about 270° so that when the doors 110 are opened, the doors 110 fold against the side walls 20 of the nook 10 and do not obstruct either the appearance or the use of the nook 10. These doors 110 close better if slide-out work surfaces 88 and the handles of the drawers (not shown) are flush with the front or leading edge of the side walls 20. The kneehole 90 in the lower portion 30 of the scrapbook nook 10 is not covered by the folding doors 110. The folding doors 110 are conventional doors and conceal the presence of storage compartments and drawers in the scrapbook nook 10. A handle 112 may be secured to each folding door 110.

It is to be understood that the present invention is not limited to the sole embodiments described above, but encompasses any and all embodiments within the scope of the following claims.

I claim:

1. A scrapbook nook, comprising:

(a) a lower portion having a first pedestal and a second pedestal spaced apart to define a kneehole cavity;

(b) a middle portion having a roll-top desk assembly including a desktop mounted on said first and second pedestals, the roll-top desk assembly further having:

(i) a pair of S-shaped side walls, each side wall having an inner surface with a groove defined therein; and (ii) a tambour slidingly engaged in the grooves defined in said side walls defining a roll-top assembly for covering said desktop;

(c) an upper portion having a storage cabinet sized and dimensioned for housing a scrapbook assembly machine and photo storage boxes;

(d) a first back wall attached to said upper, middle and lower portions; and (e) a second back wall having a vertical portion and a horizontal portion attached normal to the vertical portion, the vertical portion being spaced apart from said first back wall in order to define a cavity for storing said tambour when said tambour is in an open position.

2. The scrapbook nook according to claim 1, further comprising:

(a) a first slide-out horizontal work surface disposed between said desktop and said first pedestal; and (b) a second slide out horizontal work surface disposed between said desktop and said second pedestal;

said first and second slide-out work surfaces providing additional work space for assembling scrapbooks, each said slide-out horizontal work surface having corners rounded for safety purposes.

3. The scrapbook nook according to claim 1, wherein said first pedestal comprises a plurality of drawers, including a plurality of shallow drawers adapted for housing small scrapbook assembly implements and a large storage drawer.

4. The scrapbook nook according to claim 3, wherein said large storage drawer has a plurality of partition walls extending from front-to-back to define a plurality of vertical tiers adapted for storing scrapbook assembly supplies.

5. The scrapbook nook according to claim 3, wherein said large storage drawer has a plurality of partition walls extending from side-to-side to define a plurality of vertical tiers adapted for storing scrapbook assembly supplies, including at least one vertical tier sized and dimensioned for receiving a twelve inch by fifteen inch scrapbook album.

6. The scrapbook nook according to claim 1, wherein said second pedestal comprises an upper drawer and a lower drawer, the upper drawer having a plurality of compartments defined therein including at least one compartment having a removable trash container for receiving items of trash.

7. The scrapbook nook according to claim 6, wherein said desktop has an opening defined therein in registry with said removable trash container, whereby items of trash may be deposited through the opening into said removable trash container.

8. The scrapbook nook according to claim 6, wherein said lower drawer has a plurality of compartments defined therein, including at least one compartment sized and dimensioned for storing twelve inch by twelve inch paper.

9. The scrapbook nook according to claim 1, further comprising a first door pivotally mounted to said first pedestal and a second door pivotally mounted to said second pedestal, said doors having a closed position for enclosing said first and second pedestals, respectively, and an open position in which said doors pivot about 270° so that said doors are adjacent said pedestals.

10. The scrapbook nook according to claim 1, further comprising a writing instrument storage unit mounted on said desktop for easy accessibility of writing instruments, said writing instrument storage unit having a honeycomb structure for vertical storage of writing instruments.

11. The scrapbook nook according to claim 1, wherein said roll-top desk assembly further comprises a back wall having a cork board surface.

12. The scrapbook nook according to claim 11, further comprising a light source secured to said back wall.

13. The scrapbook nook according to claim 1, wherein said storage cabinet has a top wall, a bottom wall, two opposing side walls joining said top wall and said bottom wall, and a front wall defining a box-shaped enclosure, the front wall having two openings defined therein, said storage cabinet further comprising a plurality of doors disposed on the front wall, the plurality of doors having an open position for providing access to said storage cabinet, and a closed position covering the two openings defined in the front wall.

14. The scrapbook nook according to claim 13, further comprising a partition wall disposed between said side walls, the partition wall dividing said storage cabinet into two compartments, at least one compartment being sized and dimensioned for housing a scrapbook assembly machine.

15. A scrapbook nook, comprising:

a unitary nook having an upper portion and a lower portion;

a horizontal desktop separating said upper and lower portions, said horizontal desktop having a top surface, a bottom surface, a right side, and a left side, said horizontal desktop having an opening on said right side dimensioned and configured to receive trash which is dropped through said desktop opening;

at least two slide-out horizontal work surfaces positioned beneath said horizontal desktop for assembling scrapbooks, each said slide-out horizontal work surfaces having the exposed corners rounded for safety purposes;

a roll-top member having a plurality of slats, the first slat including a means for pulling said roll-top member in the open and closed position;

is a right and left side wall each having one side "S" shaped, said right side wall spaced from, parallel, and coextensive with a left side wall having the "S" shaped side exposed to the front of the scrapbook nook, said right and left side walls each including a groove dimensioned and configured to receive a roll-top member;

a top storage unit having a front wall, a top wall, and a bottom wall, said top storage unit located between said right and left side walls, said right and left side walls being also the left and right side walls of said top storage unit, said front wall having an outer surface and inner surface, said front wall having two openings;

a plurality of doors dimensioned and configured to enclose said openings in said front wall, said doors hingedly fastened onto said outer surface of said front wall to permit the doors to open outwardly towards the middle or sides of the scrapbook nook;

a first back wall that extends along said upper and lower portion of said unitary nook, said first back wall having grooves dimensioned and configured to receive a roll-top member;

a second back wall having a first and second section, said first section being a vertical flat wall, said second section being a horizontal wall secured to said first section at approximately a 90 degree angle, said second back wall is dimensioned and configured to fit between the upper portion of the first back wall above the desktop and below the top storage unit, said second back wall positioned in front of said first back wall which together house said roll-top member;

a plurality of drawers being positioned beneath each said horizontal work surface, said plurality of drawers arranged into a first set and a second set of drawers, each said drawer dimensioned and configured to store specific scrapbook items; and a light source secured to said second section of said second back wall.

16. A scrapbook nook according to claim 15, said left side of said top surface of said horizontal desktop including a writing instrument storage unit for easy accessibility of writing instruments.

17. A scrapbook nook according to claim 17, said left side of said top surface of said horizontal desktop including a slot dimensioned and configured for two storage areas for storing a light box and a personal trimmer.

18. A scrapbook nook according to claim 17, wherein said top storage unit includes an inner intermediate vertical support wall dividing the top storage unit into two storage components.

* * * * *